US005944213A

United States Patent [19]

Alicea et al.

[11] Patent Number: 5,944,213

[45] Date of Patent: Aug. 31, 1999

[54] DEFORMABLE RETAINING NET

[76] Inventors: Hector Alicea, 13398 Hayes Ct., Crown Point, Ind. 46307; Leslie Pickett, 5401 Dexter Dr., Merrillville, Ind. 46410

[21] Appl. No.: 09/037,574

[22] Filed: Mar. 10, 1998

[51] Int. Cl.[6] ..... B65D 45/16; B65D 51/02

[52] U.S. Cl. ..... 220/287; 24/265 H; 150/154; 220/324

[58] Field of Search ..... 220/200, 287, 220/315, 324, 326; 206/85.3, 597; 150/154, 901; 383/4; 224/328, 528, 925; 217/124, 56; 24/301, 300, 365 H, 684; 296/100.16, 100.01, 101, 50

[56] References Cited

U.S. PATENT DOCUMENTS

| | | | |
|---|---|---|---|
| 2,080,108 | 5/1937 | Brandstein | 220/287 X |
| 2,821,230 | 1/1958 | May | 150/154 |
| 3,481,371 | 12/1969 | Row | 296/100.16 |
| 3,614,154 | 10/1971 | Evans | 296/100.16 |
| 4,221,085 | 9/1980 | Conaghan | 150/154 X |
| 4,538,385 | 9/1985 | Kandarian | 150/154 |
| 5,127,137 | 7/1992 | Krauss | 24/265 H |
| 5,383,259 | 1/1995 | McIntire | 24/300 |
| 5,417,462 | 5/1995 | Hensley | 383/4 X |
| 5,502,878 | 4/1996 | Anscher | 24/265 H |
| 5,673,464 | 10/1997 | Whittaker | 24/301 |
| 5,722,125 | 3/1998 | Vasilopoulos | 24/301 |
| 5,819,974 | 10/1998 | Caldwell | 220/200 X |

FOREIGN PATENT DOCUMENTS

| | | | |
|---|---|---|---|
| 1201381 | 12/1959 | France | 150/154 |
| 2003476 | 6/1971 | Germany | 150/154 |
| 76092 | 12/1932 | Switzerland | 150/154 |
| 797458 | 7/1958 | United Kingdom | 150/154 |

*Primary Examiner*—Stephen K. Cronin
*Assistant Examiner*—Nathan Newhouse
*Attorney, Agent, or Firm*—Goldstein & Canino

[57] ABSTRACT

A deformable retaining net for securing certain items such as laundry articles within a container such as a laundry basket. The deformable retaining net comprises a netting panel which is rectangular in shape and bounded on at least two opposite sides by double-ply sleeves. An elastic drawstring having opposite ends and a connecting hook at each end each extends through each of the double-ply sleeves such that the connecting hooks are located external to said double-ply sleeves. The device is employed by securing two of the connecting hooks to any surface contours of one of the side walls of the container, and then stretching the netting panel over the open top of the container and securing the remaining connecting hooks to surface contours located upon the opposite side wall of the container, so that the netting panel is thus firmly secured across the open top of the container, and items are prevented from escaping through the open top from the container's interior.

2 Claims, 3 Drawing Sheets

DEFORMABLE RETAINING NET

FIELD OF THE INVENTION

The invention relates to a deformable retaining net. More particularly, the invention relates to a deformable retaining net which may be easily secured to the opening of various size rigid and semi-rigid containers to capture and retain the contents therein.

BACKGROUND OF THE INVENTION

The ability to secure a particular item within a non-standard container is a problem which faces may individuals. For instance, while transporting a laundry basket about a house or other location, the numerous loose items contained therein have a tendency to fall out. Placing one's hand over the opening is not always feasible in that these types of basket/containers have varying shapes such as round, square, oblong, etc. which proves difficult to cover with just one hand. Furthermore, to utilize one of only two available hands to cover the opening of the basket proves cumbersome and clumsy.

Other types of containers also suffer the same problem during transport in that their contents are incapable of being kept entirely within the interior region. To combat these problems which are inherent in laundry baskets and similar type containers, various "tie downs" are often employed, but to no avail. These devices comprise elongated strips having a fastener at each end which is to be secure to a segment of the body of the container which encapsulates the inner contents. The elongated strip portion is intended to retain the inner contents, but fails to do so effectively because of its extreme narrowness. Such devices are suitable for retaining one large integral item, but not for retaining numerous detached articles such as a basket full of laundry items. While these units may be suitable for the particular purpose employed, or for general use, they would not be as suitable for the purposes of the present invention as disclosed hereafter.

SUMMARY OF THE INVENTION

The present invention relates to a deformable retaining net. More particularly, the invention relates to a deformable retaining net which may be easily secured to the opening of various size rigid and semi-rigid containers to capture and retain the contents therein.

In accordance with the invention, there is provided a deformable retaining net which is capable of being firmly secured to containers of various shapes and configurations.

Further in accordance with the invention, there is provided a deformable retaining net which employs elastic drawstrings which are capable of being attached to surface features of the body of a container.

To the accomplishment of the above and related objects the invention may be embodied in the form illustrated in the accompanying drawings. Attention is called to the fact, however, that the drawings are illustrative only. Variations are contemplated as being part of the invention, limited only by the scope of the claims.

BRIEF DESCRIPTION OF THE DRAWINGS

In the drawings, like elements are depicted by like reference numerals. The drawings are briefly described as follows.

DETAILED DESCRIPTION OF THE PREFERRED EMBODIMENTS

Figure 1:
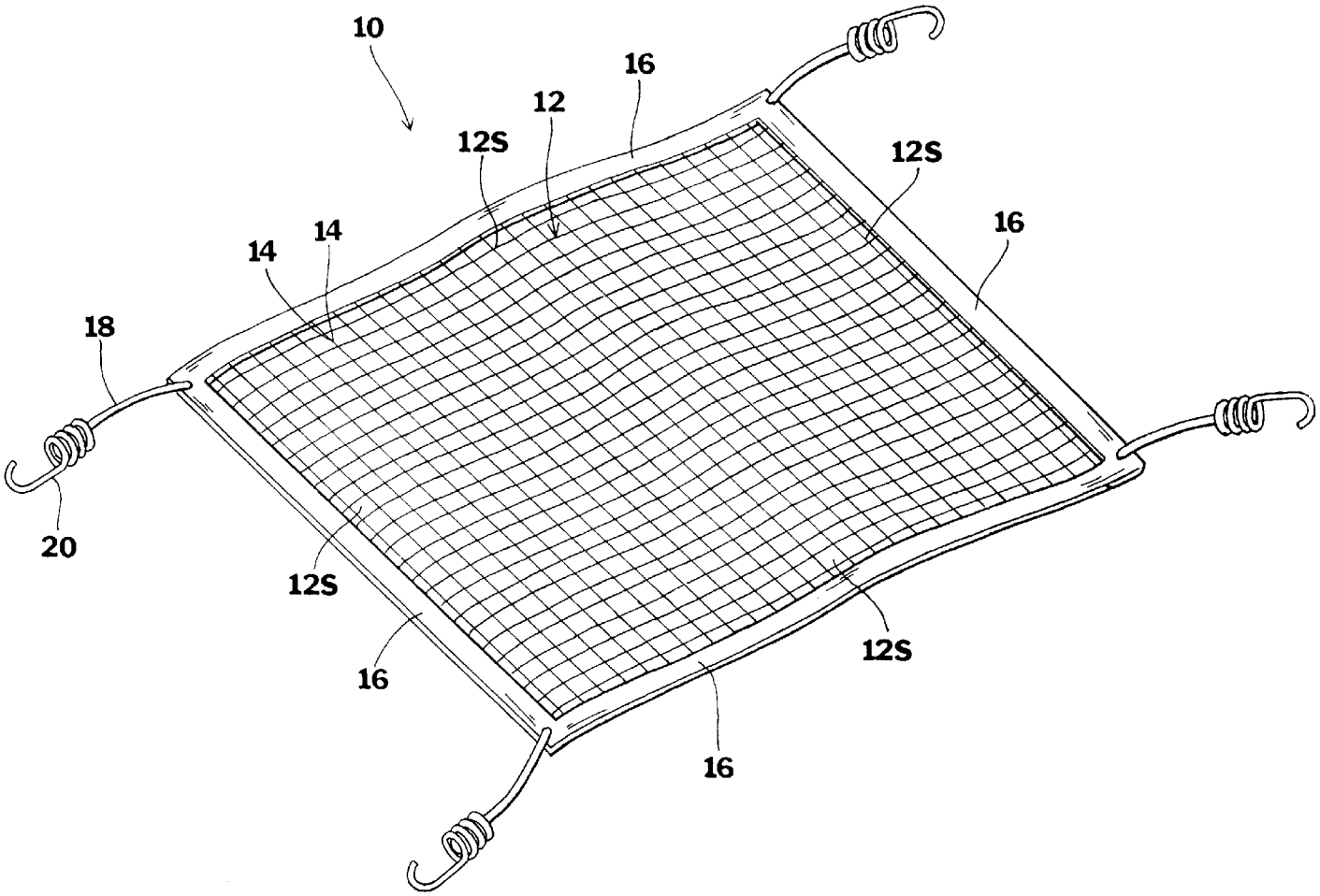
FIG. 1 is a diagrammatic perspective view of a deformable retaining net of the instant invention.

Certain terminology is used in the following description for convenience only and is not limiting. The words "right," "left," "lower" and "upper" designate directions in the drawings to which reference is made. The words "inwardly" and "outwardly" refer to directions toward and away from, respectively, the geometric center of the deformable retaining net. The words "proximal end" and "distal end" refer, respectively, to ends of an object nearer to and further from the operator of the object when the object is used in a normal fashion or as is described in the specification.

FIG. 1 illustrates a diagrammatic perspective view of a deformable retaining net 10 of the instant invention. The deformable retaining net 10 comprises a netting panel 12 which is rectangular in shape. The netting panel 12 consists of a series of interwoven elastic strands 14 as is well known in the art. The elastic feature of the interwoven strands 14 which comprise the netting panel 12 permit said panel 12 to be deformed and stretched in numerous ways, varying in size and shape as needed. The rectangular netting panel 12 has four sides 12S. In FIG. 1, all four of the sides 12S of the netting panel 12 are bounded by a double-ply sleeve 16. It is also envisioned that only two opposite sides 12S of the netting panel have the double-ply sleeve 16 secured thereto.

Figure 2:
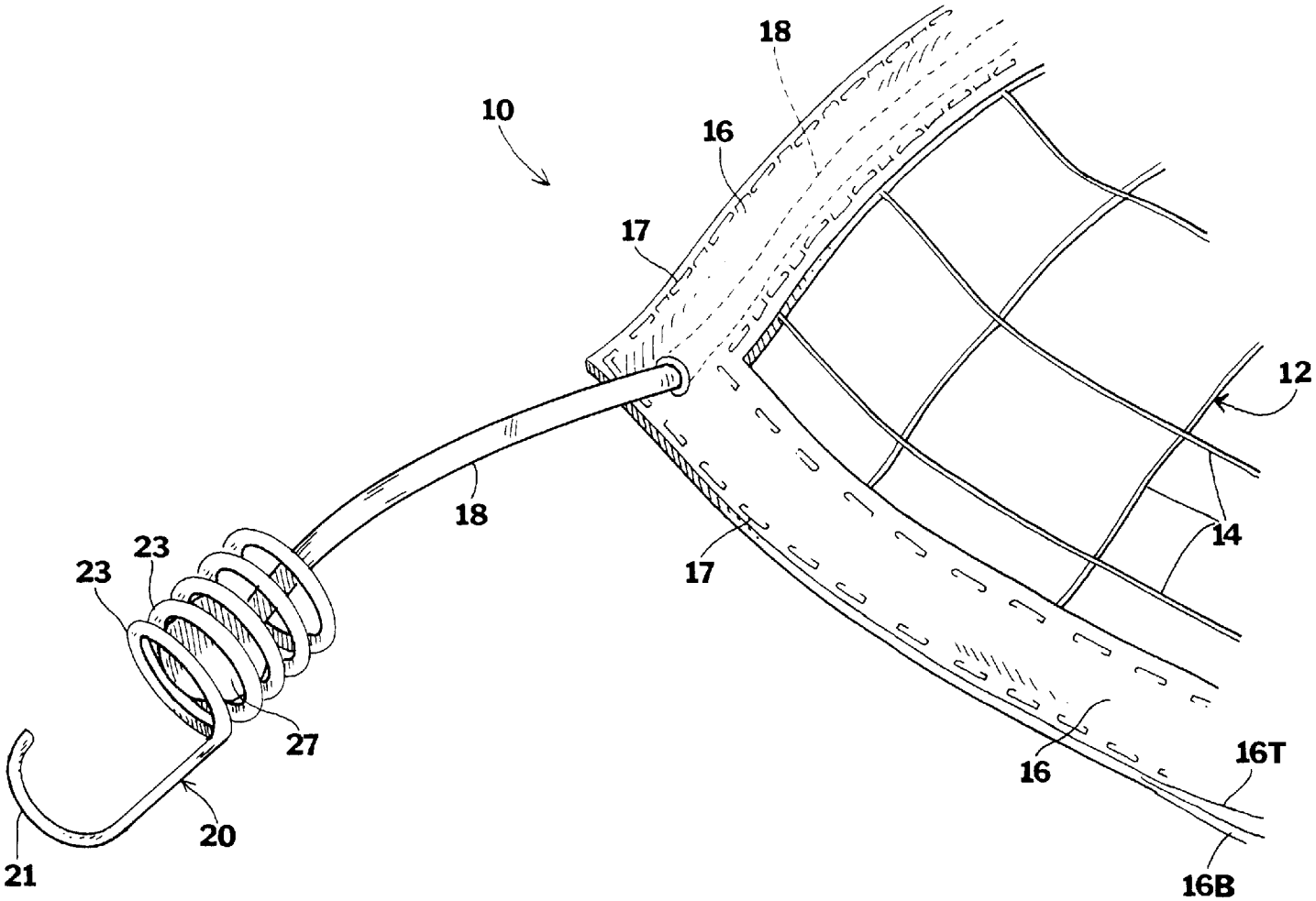
FIG. 2 is an enlarged view of an elastic drawstring and connecting hook which are an integral part of the deformable retaining net of the instant invention.

The double-ply sleeve 16 which borders the sides 12S of the netting panel 12 can be seen in more detail in FIG. 2. The double-ply sleeve 16 comprises a top ply 16T and bottom ply 16B which are secured together by a series of stitches 17 disposed along the inner and outer edge of said top 16T and bottom 16B ply. An elastic drawstring 18 extends through the double-ply sleeve 16, sandwiched between the top ply 16T and bottom ply 16B, and between the series of stitches 17 disposed along the edges thereof. The elastic drawstring 18 extends through said double-ply sleeve 16 and exits at each end, extending further outward beyond the edge of the deformable retaining net 10. The elastic drawstring 18 has two opposite ends which are external to the double-ply sleeve 16, as can be seen in FIG. 1.

As seen further in FIG. 2, each end of the elastic drawstring 18 has a connecting hook 20 pivotally secured thereto. In a preferred embodiment, the connecting hook 20 comprises a J-shaped hook portion 21 which has a series of coils 23 which encircle a sphere 27 which is secured to the end of the elastic drawstring 18. This connection configuration allows the connecting hook 20 to pivot at numerous angles with respect to the elastic drawstring 18.

Figure 3:
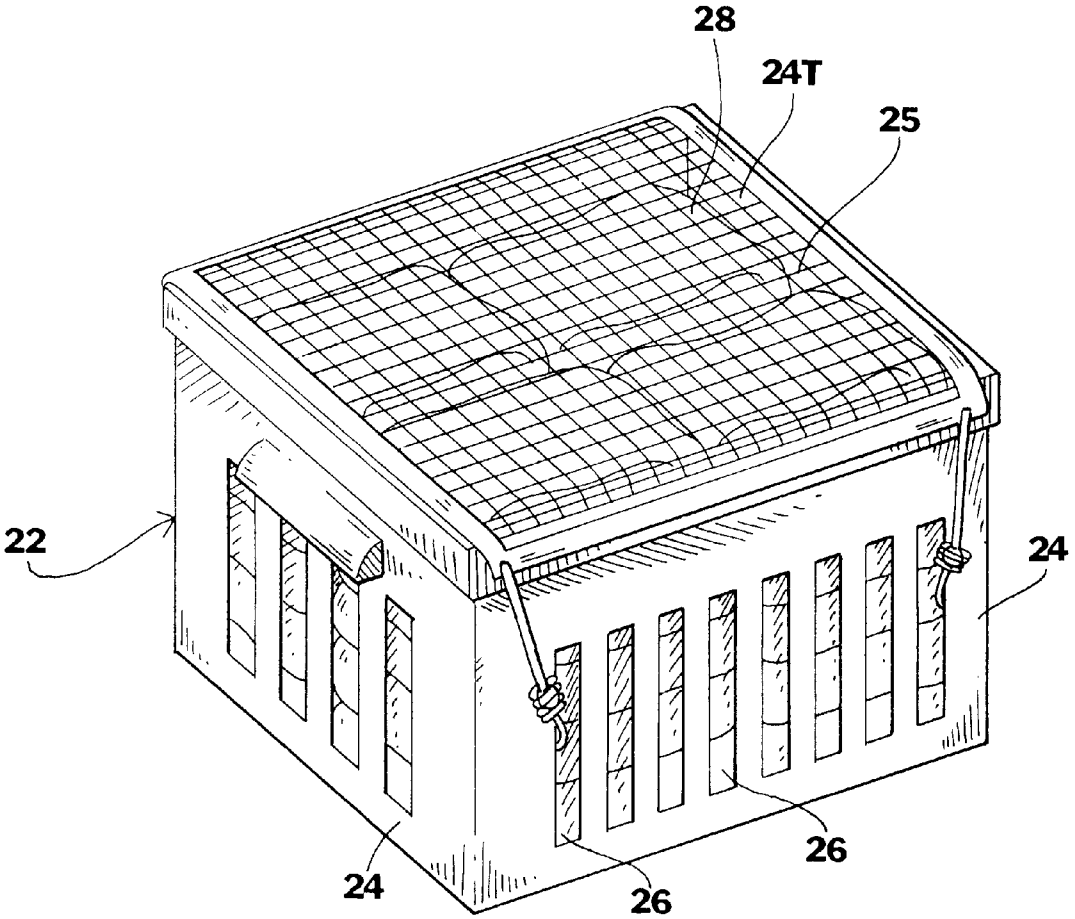
FIG. 3 is a diagrammatic perspective view of the deformable retaining net of the instant invention secured to a standard laundry basket to cover the opening thereof.

FIG. 3 illustrates a container 22 such as a laundry hamper with the deformable retaining net 10 of the instant invention installed thereupon. The container 22 shown represents standard laundry basket type containers which have a plurality of side walls 24 which define an interior region 25 and an open top 24T which is in communication with said interior region 25. A variety of items 28 such as laundry items are shown located within the interior region 25. A plurality of various surface contours 26 are located upon the side walls 24 and provide anchorage points for the connecting hooks 20 to mate with. In order to secure the deformable retaining net 10 to the container 22 and thus seal off the open top 24T so that items 28 do not escape therethrough from the interior region 25, one or more of the connecting hooks 20 are secured to the container 22 by hooking the connecting hook 20 to one of the surface contours 26 located upon the side walls 24. The netting panel 12 and elastic drawstrings 18 are then stretched over the open top 24T, and the opposite connecting hooks 20 then secured to surface contours 26 located on the opposite side wall 24. The netting panel 12 is thus firmly secured across the open top 24T of the container 22 and prevents items 28 from escaping therethrough.

What is claimed is:

1. A deformable retaining net for preventing items from spilling out of an interior region of a container, the container having a plurality of side walls which define the interior region, an open top which is in communication with the interior region and the side walls further having a plurality of surface contours disposed upon a surface thereof, the deformable retaining net comprising:

a) a netting panel having at least four sides, said netting panel consisting of a series of interwoven elastic strands;

b) a double-ply sleeve which bounds at least two sides of the netting panel;

c) a pair of elastic drawstrings, each of said drawstrings having opposite ends, one elastic drawstring extending through the double-ply sleeve at one side of the netting panel and the other elastic drawstring extending through the double-ply sleeve located at an opposite side of the netting panel, the elastic drawstrings exiting the ends of the double-ply sleeves and extending further outward beyond an edge thereof;

d) a connecting hook secured to each end of the elastic drawstrings, whereby one or more of the connecting hooks are secured to the container by hooking the connecting hook to one of the surface contours located upon the side walls, and the netting panel and elastic drawstrings are then stretched over the open top and the connecting hook on an opposite side wall is then secured to surface contours located on the opposite side wall such that the netting panel is firmly secured across the open top of the container and items contained within the interior region are prevented from escaping therefrom; and e) each connecting hook further comprising a J-shaped hook portion which has a series of coils encircling a sphere, said sphere secured to the end of the elastic drawstring, thus allowing each connecting hook to pivot at numerous angles with respect to the attached elastic drawstring.

2. The deformable retaining net of claim 1, wherein the double-ply sleeves which bound the netting panel comprise a top ply and a bottom ply which are bound together by a series of stitches disposed along inner and outer edges of each of the top and bottom ply, the elastic drawstring extending through the double-ply sleeve, sandwiched between the top ply and bottom ply, and between the series of stitches.

* * * * *